US006278470B1

(12) United States Patent
Pollutro

(10) Patent No.: US 6,278,470 B1
(45) Date of Patent: Aug. 21, 2001

(54) ENERGY EFFICIENT RF GENERATOR FOR DRIVING AN ELECTRON BEAM PRINT CARTRIDGE TO PRINT A MOVING SUBSTRATE

(75) Inventor: Dennis C. Pollutro, Cherry Creek, NY (US)

(73) Assignee: Moore U.S.A. Inc., Grand Island, NY (US)

( * ) Notice: Subject to any disclaimer, the term of this patent is extended or adjusted under 35 U.S.C. 154(b) by 0 days.

(21) Appl. No.: 09/215,784

(22) Filed: Dec. 21, 1998

(51) Int. Cl.[7] ..... B41J 2/415
(52) U.S. Cl. ..... 347/120; 347/123; 347/128
(58) Field of Search ..... 347/141, 142, 347/112, 128, 115, 123, 120

(56) References Cited

U.S. PATENT DOCUMENTS

| | | | |
|---|---|---|---|
| 4,155,093 | | 5/1979 | Fotland et al. . |
| 4,160,257 | | 7/1979 | Carrish . |
| 4,195,927 | | 4/1980 | Fotland et al. . |
| 4,267,556 | | 5/1981 | Fotland et al. . |
| 4,282,297 | | 8/1981 | Fotland . |
| 4,365,549 | | 12/1982 | Fotland et al. . |
| 4,379,969 | | 4/1983 | Cobb et al. . |
| 4,381,327 | | 4/1983 | Briere . |
| 4,409,604 | | 10/1983 | Fotland . |
| 4,448,872 | | 5/1984 | Vandervalk . |
| 4,514,781 | | 4/1985 | Plasschaert et al. . |
| 4,553,867 | * | 11/1985 | Nakai . |
| 4,558,334 | | 12/1985 | Fotland . |
| 4,679,060 | | 7/1987 | McCallum et al. . |
| 4,841,313 | | 6/1989 | Weiner . |
| 4,992,807 | * | 2/1991 | Thomson ..... 347/128 |
| 4,999,653 | | 3/1991 | Mccallum . |
| 5,006,869 | | 4/1991 | Buchan et al. . |
| 5,014,076 | * | 5/1991 | Caley, Jr. et al. . |
| 5,025,273 | | 6/1991 | Bowers . |
| 5,142,248 | | 8/1992 | Theodlulou et al. . |
| 5,175,804 | * | 12/1992 | Wittmann . |
| 5,270,742 | | 12/1993 | Aoki et al. . |
| 5,546,110 | * | 8/1996 | Lewicki, Jr. et al. ..... 347/115 |
| 5,761,583 | * | 6/1998 | Custer . |
| 5,834,150 | * | 11/1998 | Brennan et al. . |

FOREIGN PATENT DOCUMENTS 0 460 760 12/1991 (EP) .

OTHER PUBLICATIONS

Waes, Walter;"Quality, Performance and Applications of Digital Printing Systems"; Jun. 1996; Dig2prnt.doc; V 1.02; p. 6.*

* cited by examiner

*Primary Examiner*—Susan S. Y. Lee
(74) *Attorney, Agent, or Firm*—Nixon & Vanderhye P.C.

(57) ABSTRACT

An electron beam printer assembly for operating a standard electron beam print cartridge (such as an eighteen inch 600 DPI print cartridge) includes an RF generator which has a powdered iron core transformer, and a dual pulse width generator operatively connected to the transformer. The RF generator also includes a power driver, control logic, and an oscillator feedback circuit. The dual pulse width generator may comprise a NOR gate, a capacitor, two resistors, and a diode, all connected to an adjustable voltage source. The transformer core may be toroid-shaped, and of carbonyl SF. Using this RF generator it is possible to image a substrate moving at a speed of greater than 200 FPM, and to operate at a frequency of about 5 MHz in an efficient manner, to eliminate print gradients due to an overdriven transformer, to eliminate transformer temperature failures due to core loss, and to provide greater flexibility in transformer construction and design, and less power loss in the transformer drive transistor.

19 Claims, 4 Drawing Sheets

ENERGY EFFICIENT RF GENERATOR FOR DRIVING AN ELECTRON BEAM PRINT CARTRIDGE TO PRINT A MOVING SUBSTRATE

BACKGROUND AND SUMMARY OF THE INVENTION

The standard RF generator used in the majority of electron beam printers today uses the natural resonance of the driver and the print cartridge. U.S. Pat. No. 4,841,313 (the disclosure of which is hereby incorporated by reference herein), describes the purpose of the generator and a transformer-coupled resonant circuit, wherein the inductance of the secondary winding and the capacitance of the print cartridge load define the resonant frequency. It also describes the method of AC generation, oscillator feedback, and trigger generation that's responsive to the secondary AC. U.S. Pat. No. 5,142,248 (the disclosure of which is hereby incorporated by reference herein), expands on the '313 patent by the addition of a common feedback circuit connected to all transformers and the enable circuit.

Through all the descriptions in the above references, nothing is disclosed about the print cartridges power consumption or the need for an efficient RF generator or transformer for the generator.

Current practices that the present invention is intended to improve upon include:

1. Printer speeds limited to less than 200 FPM for an 18 inch 600 DPI print cartridge.
2. Print gradients on current 18" print cartridge.
3. Ceiling of 2.5 MHz RF frequency for efficient operation.
4. Limited transformer turns ratio (due to ferrite properties)
5. Limited choice of operating frequency (due to turns ratio)
6. Transformer failures due to temperature.
7. Upper frequency limited by core temperature to a compromised limit of 5 MHz.
8. High power losses in transformer drive transistor.

Conventional RF generators used to drive a 600 DPI 18 inch print cartridge use 2000–2200 volt, 5 MHz resonant transformers operating at power levels of 550 watts peak. Core loss at the frequencies required to drive the 600 DPI cartridge have been found to raise the temperature of the transformer to 100 degrees C. when running equivalent press speeds of 150 feet per minute, the temperature quoted by core manufactures as a recommended upper limit. Core temperature continues to rise as the printers speed rises. One manufacture disables its generator when printing and no charge is required, thus lowering the core temperature and allowing for greater printer speed. A method of disabling a generator while printing is described in U.S. Pat. No. 4,990,942. This method reduces the burden on the RF generators as well as the transformers temperature. However printing speeds then become dependent on coverage.

To get full output, the current designs over drive the transformer. This puts undue stress on the supporting drive electronics and causes the output wave to be distorted. The distortion can result in a print density gradient across the length of the print cartridges' RF driveline. It also tends to reduce the natural resonant frequency of the generator.

Conventional transformers have been constructed with ferrite material. The advantage of this type of construction is that the core permeability can be chosen to ensure a minimum number of wire turns for a given value of inductance, thus reducing resistive and capacitance loses. Above 2.5 MHz the advantages of low wire resistance are over shadowed by the ferrite core losses for this type of application.

In the energy efficient HF RF oscillator for electron beam printers according to the invention, the above deficiencies are overcome by using a "powdered iron core transformer" and a "dual pulse width generator", with the following results:

1. Printer speeds to 300 FPM (e.g. about 210–300 FPM and all narrower ranges within that broad range) for an 18 inch 600 DPI print cartridge.
2. No print gradient due to an over driven transformer.
3. Efficient operation at 5 MHz is now possible.
4. Greater flexibility in transformer turns ratio designs.
5. Choice of operating frequency due to the low loss properties of the powdered iron core.
6. No transformer temperature failures due to core loss.
7. No compromise operation at 5 MHz, with higher frequency designs possible by proper core selection.
8. Reduced power losses in the transformer drive transistor.

The remainder of the system according to the invention utilizes standard digital, RF and analog practices found in gated power oscillators.

The RF Generators according to the invention produce bursts of high voltage AC, which are applied to the drive lines of a print cartridge, causing an ion producing discharge. Typically there are ten generators on each of two identical boards to drive the nineteen lines on the cartridge. When the board is used to drive the right side of the cartridge, it utilizes all ten channels. When used as a left driver, only nine channels are typically utilized.

A resonant feedback oscillator circuit, using digital logic elements as part of a nonlinear feedback path, produces the high voltage AC burst. The oscillator approach was chosen over an amplifier because it offers greater stability in the presence of a changeable load and an opportunity to achieve higher efficiency. This is desirable because of the high power levels of 550 watts peak at 5-MHz are involved. Voltages of 2200 volts peak to peak require a step up transformer.

According to one aspect of the present invention an electron beam printer assembly is provided comprising: An RF generator including a powdered iron core transformer, a power driver, control logic, and an oscillator feedback circuit; and, the transformer connected to an electron beam print cartridge. Preferably the RF generator further comprises a dual pulse width generator operatively connected to the transformer. The transformer preferably comprises primary, secondary, and clamping windings, the secondary winding connected to the cartridge. The cartridge (preferably a conventional cartridge such as shown in U.S. Pat. Nos. 4,160,257, 4,408,214, 4,494,129, 5,014,076 and/or 5,315,324) may comprise an eighteen inch 600 DPI print cartridge. Typically the assembly is capable of effectively printing a substrate moving at a speed over 200 feet per minute, e.g. 210–300 feet per minute.

The dual pulse width generator may comprise a NOR gate, capacitor, two resistors, and a diode, all connected to an adjustable voltage source. The transformer may have a toroid-shaped core, e.g. of carbonyl SF. Typically ten of the generators are mounted to a drive board, and two drive boards are provided; and the cartridge has nineteen channels.

According to another aspect of the present invention an electron beam printer assembly is provided comprising: An RF generator including a dual pulse width generator connected to a transformer; and an electron beam print cartridge connected to the transformer. The details of the components are preferably as described above.

According to another aspect of the present invention a method of imaging a substrate (such as paper) using an electron beam print cartridge and an RF generator is provided. The method comprises: (a) Moving the substrate at a speed greater than 200 FPM. And, (b) while practicing (a), operating the RF generator at a frequency greater than 3 MHz to drive the cartridge and thereby image the moving web.

In the method, (b) is preferably practiced using an RF generator having a powdered iron core transformer, and a dual pulse width generator. Also (b) is typically practiced using a 600 DPI eighteen inch print cartridge, and operating the RF generator at a frequency of about 5 MHz. In the practice of the method, (a) is preferably practiced at a speed of about 210–300 FPM.

It is the primary object of the present invention to provide enhanced efficiency of an RF generator for powering a print cartridge. This and other objects of the invention will become clear from an inspection of the detailed description of the invention and from the appended claims.

DETAILED DESCRIPTION OF THE DRAWINGS

Figure 1A:
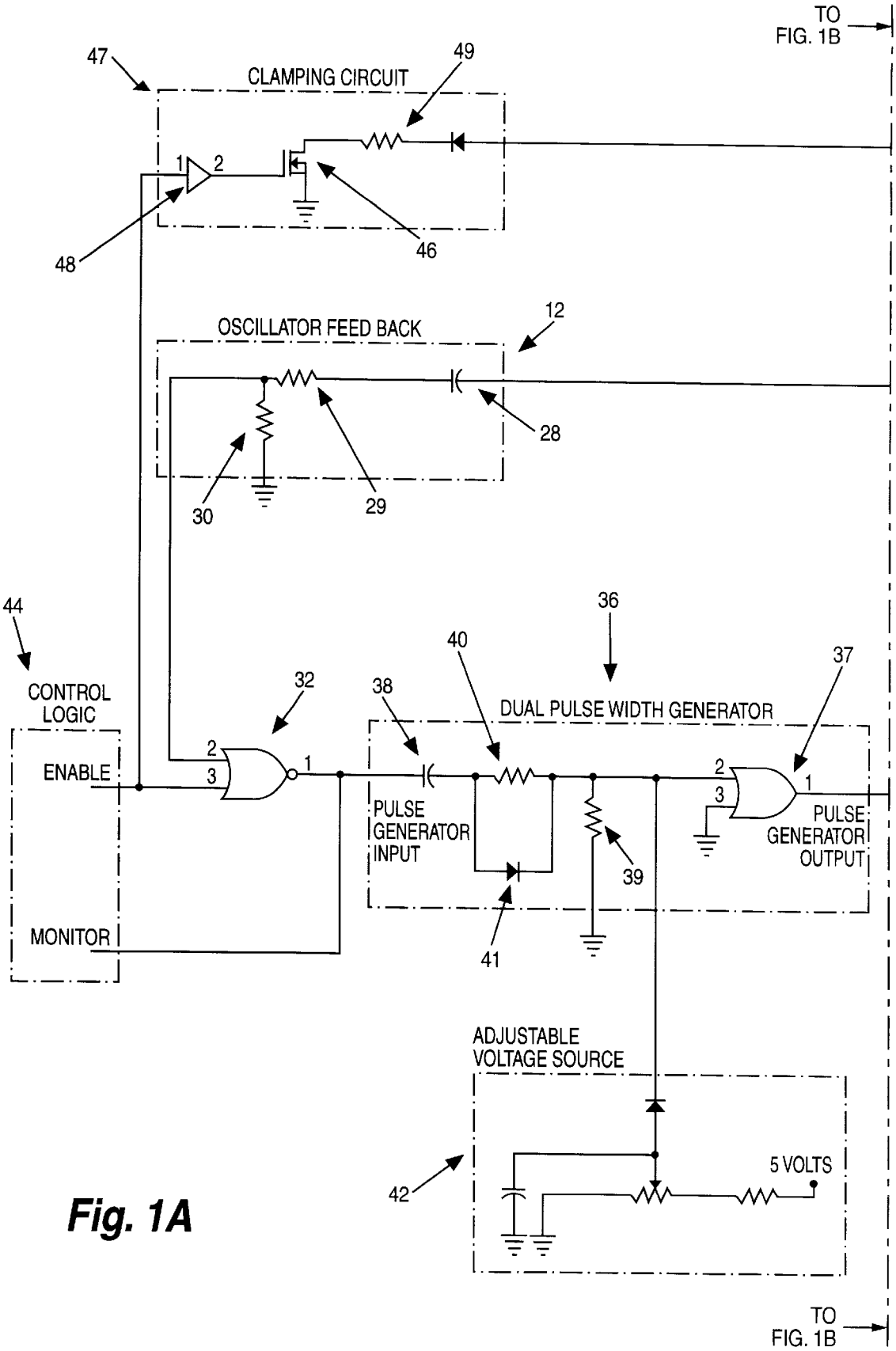
FIGS. 1A and 1B provide a circuit diagram for an exemplary RF generator according to the present invention.
Figure 1B:
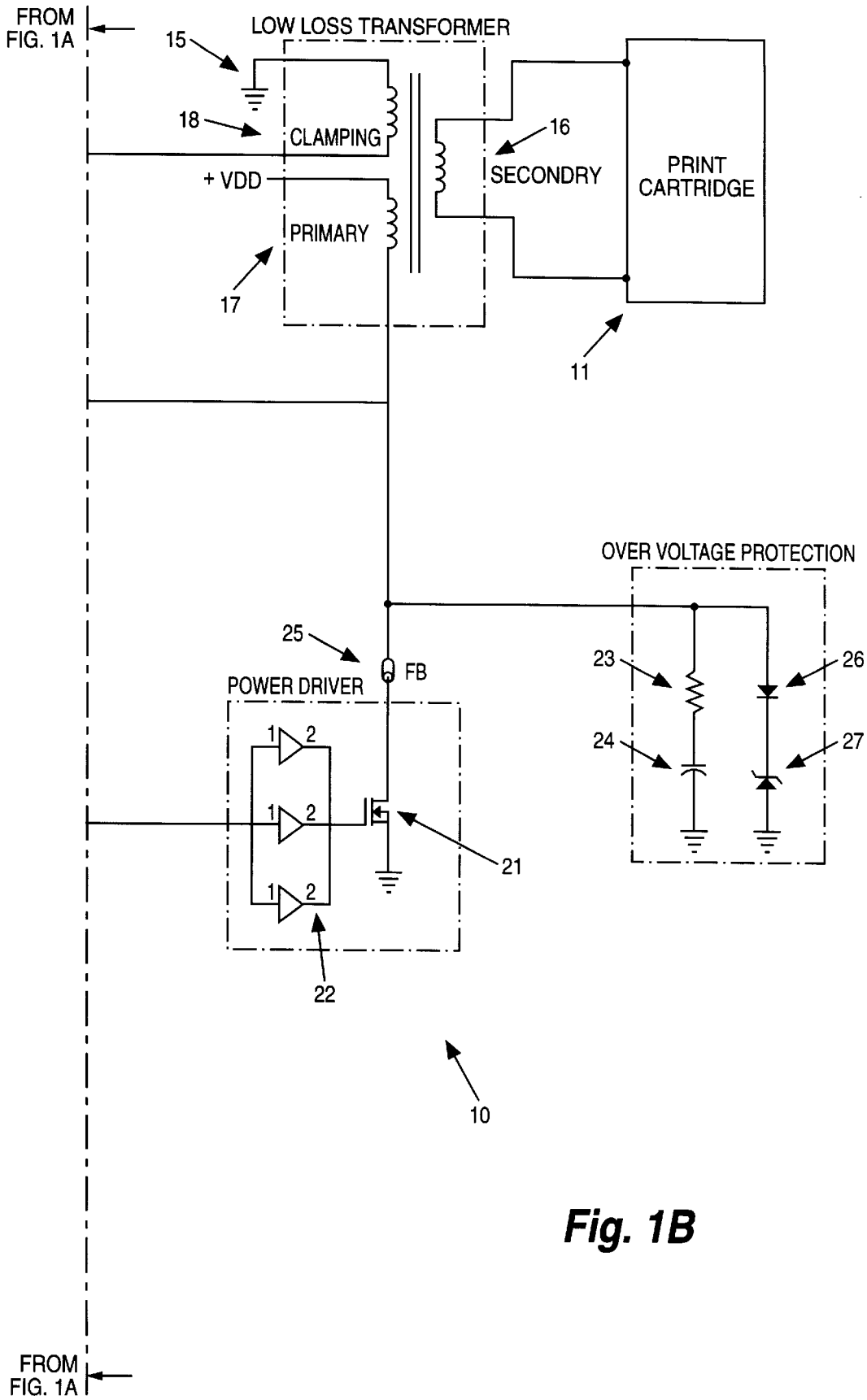

An RF generator according to the present invention is shown generally by reference numeral 10 in FIG. 1B. RF generator 10 produces bursts of high voltage (e.g. 2000+) AC which are applied to the drive lies of a conventional print cartridge 11, such as shown in U.S. Pat. Nos. 4,160,257, 4,408,214, 4,494,129, 5,014,076 and/or 5,315,324. For example an eighteen inch 600 DPI cartridge 11 may be used, which is simulated for testing by (see FIG. 6) a resistor 13 of fourteen ohm, and a capacitor 14 of 180 pf. The cartridge 11 has a $V_{ac}$ of 2200, and an $F_o$ of five MHz. The cartridge 11 typically has a drive and finger electrodes separated by a dielectric, and a screen electrode, as described in the previously mentioned patents.

For driving a cartridge 11 there typically are ten generators 10 on each of two identical driver boards to typically drive nineteen lines on the cartridge 11. The right board uses all ten channels, the left board typically only nine of the ten.

The RF generator 10 preferably comprises a resonant feedback oscillator circuit 12, as shown in FIG. 1A, using digital logic elements as part of a non-linear feedback path, to produce the high voltage AC bursts.

In the RF generator 10, the resonant circuit, or tank circuit, is formed by the magnetizing inductance of the low loss transformer 15 according to the invention, and the capacitance 16, seen at the secondary coil of the transformer 15 in FIG. 1B. The transformer 15 typically uses 0.8 inch diameter toroid of Micrometals type 6 material, i.e. a powdered iron core (e.g. of carbonyl SF). Part number T80-6 gives an inductance index (AL) of 4.5 nanohenries per turns-squared. With a 30-turn secondary and transformer—circuit board connections, the inductance is 4.5 microhenries. The primary winding 17 of transformer 15 may be a six turn pair of wires, as may be the clamping winding 18. The windings are arranged to reduce leakage inductance. Twenty-gauge wire is preferably used on the secondary winding 16 to reduce copper losses. The load capacitance principally comprises the cartridge 11 capacitance of about 180-pf. Additional-winding capacitance of the transformer 15 and the circuit board (not shown) total about 40-pf, for a total load capacitance of about 220-pf.

The resonant frequency developed with the transformer 15 and cartridge 11 are about five MHz. The nominal frequency of operation is selected at this stage of the design, thus dictating the transformer's secondary winding 16 inductance required to achieve the design frequency. This is considered a fixed frequency generator, however if the load capacitance seen by the transformer 15 changes so does the frequency. This enables the generator 10 to operate at maximum efficiently without regard to small changes in the print cartridge 11 load. Should the generator frequency shift, beyond the printer's operating window, a monitor circuit shuts down the oscillator.

Figure 2:
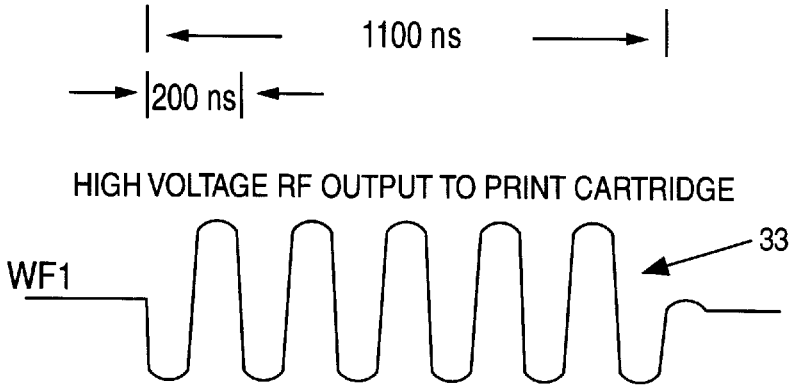
FIGS. 2 through 5 are schematic representations of various waveforms for components of the generator of FIGS. 1A and 1B during operation of the generator according to the invention.

By substitution, it has been found that the print cartridge 11 can be modeled (see FIG. 6) as a 14.5-ohm resistor 13 in series with a 180-pf capacitor 14. The resistor 13 represents the power dissipated in the cartridge 11. Thus the power flow to a driveline, while it is energized, is about 550 watts. In addition the energy stored in the tank circuit is lost at the end of each burst and must be replaced on the next start. See the waveform 33 of FIG. 2.

To handle this power a high voltage IRF 840 FET may be used as the driver transistor 21. Three parallel Elantec EL7104 MOS clock drivers 22, operating at 15 volts, may be used to drive transistor 21. An R-C snubber circuit, 23, 24, and a ferrite bead, 25, are preferably used at the drain of the transistor 21 to absorb high frequency voltage spikes and suppress VHF oscillations due to transformer 15 and circuit board leakage inductance. Diodes 26 and 27 are also connected to the drain of transistor 21 to prevent over-voltaging the transistor 21 during unusual operating conditions. An AC coupled voltage divider, 28–30, senses the voltage across the transistor 21. The output of the circuit 12 is DC biased (components not shown) to just below the threshold of the NOR gate 32 pin two.

Elements 21 and 22 comprise a power driver circuit. Elements 23, 24, 26 and 27 comprise an over voltage protection circuit.

Figure 3:
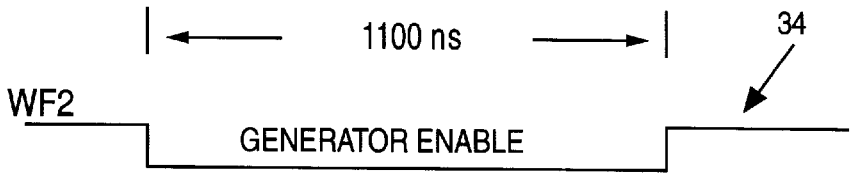
Figure 4:
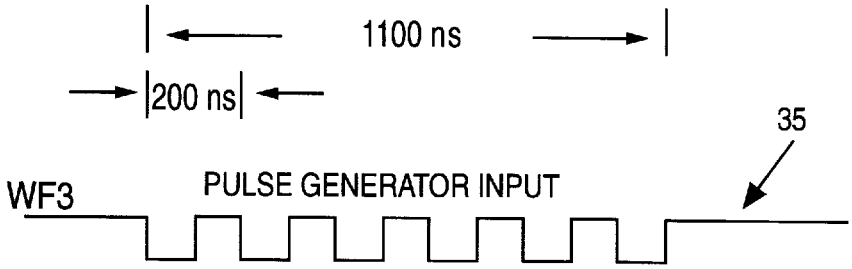

The NOR gate 32, pin one, gives a positive going transition when the Enable* signal first goes low and each time the output of the voltage divider goes from high to low while the Enable* is low. See the waveforms 34, 35, respectively, of FIGS. 3 and 4. Each transition produces a positive going pulse at the output of the "dual pulse width generator", circuit 36, including a NOR gate 37, capacitor 38, resistors 39, 40, and diode 41, and the setting of the adjustable voltage source 42 determine the pulse width. The adjustable voltage source 42 has a DC output between 0 and 1.8 volts, which is below the threshold of generator 37. When the output of NOR gate 32 is at a logic zero, capacitor 38 charges to the adjustable voltage source 42 DC output level via elements 40, 41. This is the condition the generator 10 is in prior to receiving an Enable* signal from control logic 44. When element 32 goes high the sum of the stored charge on capacitor 38 and the output voltage of element 32, now at five volts, are directed through diode 41 and applied across resistor 40 and element 37.

Figure 5:
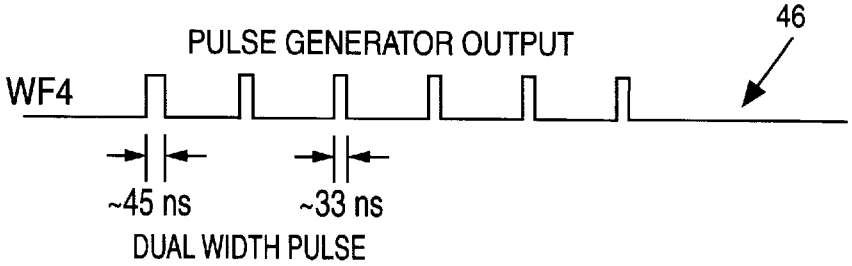

Increasing the setting of the adjustable voltage source 42 produces longer pulses; a nominal pulse width is forty-five nano seconds for the first, the remaining pulses are a nominal thirty-three nano seconds. The remaining pulses are shorter because capacitor 38 does not fully charge to the adjustable voltage source 42 DC output before element 32's output switches high again. See waveform 46 in FIG. 5. For class "E" power amplifiers the driving pulse is applied for $1/6^{th}$ the time of a full cycle. For 5 MHz, a 200 ns cycle time, this is 33 ns. For a design of 10 MHz a 100 ns-cycle time, a pulse width of 16 to 17 ns is appropriate with a period between of 100 ns. To fully charge the tank circuit only the start pulse is longer than the $1/6^{th}$ cycle time.

The pulse passes through driver 22 to turn on the power transistor 21. The current that results from the "first" pulse" is limited only by the transconductance of the transistor 21. Thus, the first pulse has a predominant effect on the first cycle of oscillation of the tank circuit. The pulse width should be adjusted so that the second half of the first cycle of oscillation, the positive half, is fully developed. This first cycle requires the transistor, 21, to supply enough energy to charge the tank and the load. The succeeding pulses are generated when the AC is at the zero crossing point. The current that flows in transistor 21 in response to the following feed back pulses is reduced, as it is only necessary to replenish the lost power in the tank circuit. Should the feedback pulses delivered to transistor 21 be longer than necessary it will tend to lower the over all generator frequency, increase the power dissipated in transistor 21, and distort the output sine wave. Simply put: one should supply enough energy to fully develop the first cycle and only enough energy to replenish the remaining cycles. As the amplitude of the oscillation, seen at the drain of transistor 21, approaches twice the supply voltage VDD, a reverse current may flow through the integral diode of transistor 21. This effect serves to regulate the amplitude of oscillation at the primary 17 of transformer 15.

When the Enable* signal goes high, no more drive pulses can occur. In addition, the clamping transistor 46 of clamping circuit 47 is turned on through the MOS driver 48. The transistor 46, which had been turned off at the beginning of the burst, clamps the next positive half cycle to ground thorough resistor 49. The energy stored in the tank circuit is dissipated in the resistor 49, bringing the AC output to zero in one cycle. The energy dissipated is approximately 133 microjoules for each burst. At 300 feet per minute, a 36 KHz-burst rate, this represents an average power flow to the resistor 49 of about 4.8 watts.

Two problem areas are operation into an open or short circuit load, which result from poor cartridge connections and cartridge failure. Open circuit operation results in tank circuit voltage higher than normal, causing diodes 26 and 27 to conduct. Short circuit operation may result in oscillation caused by the leakage inductance resonating with the drain capacitance of transistor 21 at a frequency higher than that of normal operation. This leads to excessive power dissipation in the transistor 21 sufficient to cause failure. Both of these problems exhibit oscillations at a frequency higher than that of normal operation.

High frequency shut down of the generator 10, while in this condition, will reduce the problems associated with open and shorted loads. High frequency shut down is achieved by monitoring the feed back at the output of element 32 and removing the generator Enable* signal from control logic 44. A monitor circuit, such as an ASIC located on board near the 10 RF channels, measures the feed back pulse width. Should the ASIC determine the pulse is too narrow (the narrower the pulse the higher the frequency) it will disable the generator 10 and enables the appropriate RF channel LED. From this point on the generator 10 is no longer enabled until the RF PCB receives a reset.

In normal operation at the maximum speed of 300 feet per minute nineteen generators will draw about 2.4 amps at 220 volts input. This is nearly 28 watts per circuit. Approximately 15.5 watts RMS per circuit goes into the cartridge 11. The remaining power, 120 watts per board, must be removed from the generator boards and the drive electronics enclosure.

Figure 6:
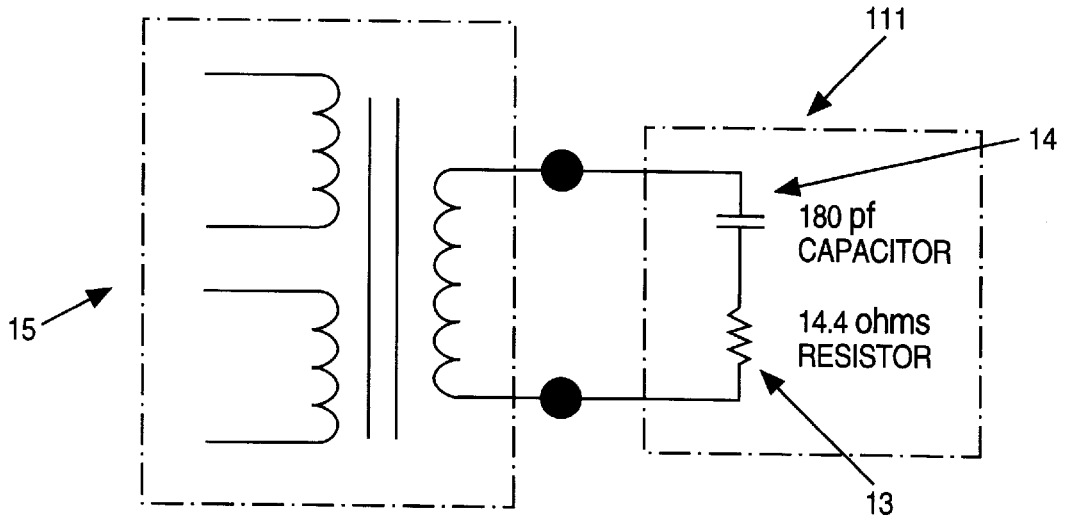
FIGS. 6 and 7 are schematic illustrations showing the configuration of the transformer according to the present invention during testing thereof to establish its advantages compared to conventional generators.
Figure 7:
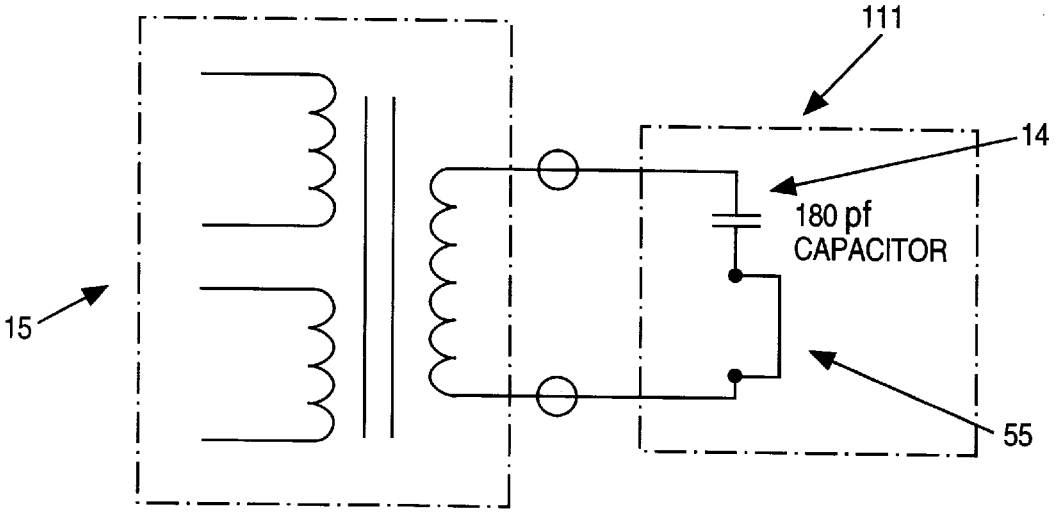

Testing of an RF generator according to the invention, which uses a transformer 15 with powdered iron core, compared with conventional RF generators with ferrite transformer cores, reveals the advantages according to the invention. FIG. 6 schematically shows a loaded Q test of a simulated cartridge 111 with a 14.4 ohm resistor 13 and 180 pf capacitor 14 connected to a transformer 15 according to the invention. FIG. 7 is the same as FIG. 6 only for an unloaded Q test, i.e. where resistor 13 has been shorted out as indicated by short 55 in FIG. 7. Similar tests were done using otherwise substantially identical transformers with ferrite cores. The results of these comparative tests, as well as the test conditions, are set forth in Tables I–IV.

TABLE I

DATA TABLE FOR LOADED Q

| | Test #1 (Loaded Q) FERRITE | Test #2 (Loaded Q) FERRITE | Test #3 (Loaded Q) POWDER IRON |
|---|---|---|---|
| | 1811 Pot Core AL = 24<br>Material = 4C6 Philips<br>Pri = 2T Sec = 13T<br>L = 4.37 uH Capacitance = 220 pf<br>Load Resistance ≅ 14.4<br>Freqency = 5.176 Mhz | 1811 Pot Core AL = 40<br>Material = 4C6 Philips<br>Pri = 2T Sec = 13T<br>L = 4.62 uH Capacitance = 220 pf<br>Load Resistance ≅ 14.4<br>Freqency = 4.950 Mhz | Toroid T80-6 Core AL = 4.5<br>Material = Carbonyl SF MICROMETALS<br>Pri = 6T Sec = 30T<br>L = 4.64 uH Capacitance = 220 pf<br>Load Resistance ≅ 14.4<br>Freqency = 4.963 Mhz |
| Voltage peak for cycle #1 | 1110 | 1110 | 1099 |
| Voltage peak for cycle #2 | 790 | 770 | 862 |
| Voltage peak for cycle #3 | 560 | 540 | 670 |
| Energy stored in 1st cycle $\omega = e^2 * c/2$ | $135.531 \times 10^{-6}$ | $135.531 \times 10^{-6}$ | $132.858 \times 10^{-6}$ |
| Energy stored in 2nd cycle $\omega = e^2 * c/2$ | $68.651 \times 10^{-6}$ | $65.219 \times 10^{-6}$ | $81.734 \times 10^{-6}$ |

TABLE I-continued

DATA TABLE FOR LOADED Q

| | Test #1 (Loaded Q) FERRITE | Test #2 (Loaded Q) FERRITE | Test #3 (Loaded Q) POWDER IRON |
|---|---|---|---|
| Energy stored in 3rd cycle $\omega = e^2*c/2$ | $34.496 \times 10^{-6}$ | $32.076 \times 10^{-6}$ | $49.379 \times 10^{-6}$ |
| Energy stored in 4th cycle $\omega = e^2*c/2$ | | | $29.174 \times 10^{-6}$ |
| Energy lost = (Energy of 1st cycle-Energy of 2nd cycle) | $66.88 \times 10^{-6}$ | $70.312 \times 10^{-6}$ | $51.124 \times 10^{-6}$ |
| Energy lost = (Energy of 2nd cycle-Energy of 3rd cycle) | $34.155 \times 10^{-6}$ | $33.143 \times 10^{-6}$ | $32.355 \times 10^{-6}$ |
| $Q = 2\pi * \omega_s/\omega_L$ | 12.73 | 12.11 | 16 |
| $Q = 2\pi * \omega_s/\omega_L$ | 12.63 | 12.36 | 15.9 |
| Average Q = (Q1 + Q2)/2 | 13 | 12 | 16 |

TABLE II

DATA TABLE FOR UNLOADED Q

| | Test #1 (Unloaded Q) FERRITE | Test #2 (Unloaded Q) FERRITE | Test #3 (Unloaded Q) POWDER IRON |
|---|---|---|---|
| | 1811 Pot Core AL = 24<br>Material = 4C6 Philips<br>Pri = 2T Sec = 13T<br>L = 4.37 uH Capacitance = 220 pf<br>Load Resistance ≅ 0<br>Freqency = 5.176 Mhz | 1811 Pot Core AL = 40<br>Material = 4C6 Philips<br>Pri = 2T Sec = 13T<br>L = 4.62 uH Capacitance = 220 pf<br>Load Resistance ≅ 0<br>Freqency = 4.988 Mhz | Toroid T80-6 Core AL = 4.5<br>Material = Carbonyl SF MICROMETALS<br>Pri = 6T Sec = 30T<br>L = 4.57 uH Capacitance = 220 pf<br>Load Resistance ≅ 0<br>Freqency = 4.946 Mhz |
| Voltage peak for cycle #1 | 1099 | 1110 | 1099 |
| Voltage peak for cycle #2 | 985 | 950 | 1035 |
| Voltage peak for cycle #3 | 875 | 820 | 985 |
| Energy stored in 1st cycle $\omega = e^2*c/2$ | $132.858 \times 10^{-6}$ | $135.531 \times 10^{-6}$ | $132.858 \times 10^{-6}$ |
| Energy stored in 2nd cycle $\omega = e^2*c/2$ | $106.724 \times 10^{-6}$ | $99.275 \times 10^{-6}$ | $117.834 \times 10^{-6}$ |
| Energy stored in 3rd cycle $\omega = e^2*c/2$ | $84.218 \times 10^{-6}$ | $73.964 \times 10^{-6}$ | $106.724 \times 10^{-6}$ |
| Energy lost = (Energy of 1st cycle-Energy of 2nd cycle) | $26.134 \times 10^{-6}$ | $36.256 \times 10^{-6}$ | 15.024 |
| Energy lost = (Energy of 2nd cycle-Energy of 3rd cycle) | $22.506 \times 10^{-6}$ | $25.311 \times 10^{-6}$ | 11.11 |
| Energy lost = (Energy of 3rd cycle-Energy of 4th cycle) | | | 10.765 |
| $Q = 2\pi * \omega_s/\omega_L$ | 31.94 | 23.49 | 55.6 |
| $Q = 2\pi * \omega_s/\omega_L$ | 29.80 | 24.64 | 66.6 |
| Average Q = (Q1 + Q2)/2 | 31 | 24 | 61 |

TABLE III

FULL LOAD Generator efficiency using Ferrite and Powdered Iron transformers.

FERRITE

1811 Pot Core AL = 24
Pri = 2T Sec = 13T
L = 4.37 uH Capacitance = 220 pf
Load Resistance ≅ 14.4 Frequency = 6 Mhz
Vin = 167 Vdc Vout = 1100 Vp

| Speed and Frequency | Input Current (Measured) | Input Power Vin × 1 input | % ON-Time |
|---|---|---|---|
| 30 ft/min 3.6 KHZ | 25 | 4.175 | 0.396 |
| 50 ft/min 6 KHZ | 42 | 7.014 | 0.66 |
| 100 ft/min 12 KHZ | 83 | 13.861 | 1.32 |
| 150 ft/min 18 KHZ | 124 | 20.708 | 1.98 |
| 200 ft/min 24 KHZ | 163 | 27.221 | 2.64 |
| 250 ft/min 30 KHZ | 202 | 33.734 | 3.3 |
| 300 ft/min 36 KHZ | 240 | 40.08 | 3.96 |

TABLE III-continued

FULL LOAD Generator efficiency using Ferrite and Powdered Iron transformers.

| | |
|---|---|
| Load Resistor (R) | 14.4 |
| Xc = ½ πfc | 176.84 |
| Z (Load) | 177.42 |
| Output Voltage (Measured) | 1100 Vpk |
| Ipk = E/Z | 6.19 Amp |
| Output Peak Power = $I^2R$ | 553.5 Watt |
| Output RMS Power = $0.707\ I^2R$ | 391.3 Watt |

TABLE III-continued

FULL LOAD Generator efficiency using Ferrite and Powdered Iron transformers.

| | | | | | | | |
|---|---|---|---|---|---|---|---|
| Actual RMS Power = RMS | 3.6 | 6 | 12 | 18 | 24 | 30 | 36 |
| Power X % ON-Time/100 @ various frequency | 1.55 | 2.6 | 5.2 | 7.7 | 10.3 | 12.9 | 14.4 |
| % Efficiency = 100 X Output Power/Input Power | 37 | 37 | 38 | 37 | 38 | 38 | 36 |
| Average Efficiency | | | | 37% | | | |

FERRITE

1811 Pot Core AL = 40
Pri = 2T Sec = 11T
L = 4.62 uH Capacitance = 220 pf
Load Resistance ≅ 14.4 Frequency = 4.950 Mhz
Vin = 230 Vdc Vout = 1100 Vp

| Speed and Frequency | Input Current (Measured) | Input Power Vin × 1 input | % ON-Time |
|---|---|---|---|
| 30 ft/min 3.6 KHZ | 17 | 3.91 | 0.396 |
| 50 ft/min 6 KHZ | 29 | 6.67 | 0.66 |
| 100 ft/min 12 KHZ | 57 | 13.11 | 1.32 |
| 150 ft/min 18 KHZ | 86 | 19.78 | 1.98 |
| 200 ft/min 24 KHZ | 115 | 26.45 | 2.64 |
| 250 ft/min 30 KHZ | 141 | 32.43 | 3.3 |
| 300 ft/min 36 KHZ | 169 | 38.87 | 3.96 |
| Load Resistor (R) | 14.4 | | |
| Xc = ½ πfc | 176.84 | | |
| Z (Load) | 177.42 | | |
| Output Voltage (Measured) | 1100 Vpk | | |
| Ipk = E/Z | 6.19 Amp | | |
| Output Peak Power = $I^2R$ | 553.5 Watt | | |
| Output RMS Power = 0.707 $I^2R$ | 391.3 Watt | | |

| | | | | | | | |
|---|---|---|---|---|---|---|---|
| Actual RMS Power = RMS | 3.6 | 6 | 12 | 18 | 24 | 30 | 36 |
| Power X % ON-Time/100 @ various frequency | 1.5 | 2.6 | 5.2 | 7.7 | 10.3 | 12.9 | 14.4 |
| % Efficiency = 100 X Output Power/Input Power | 40 | 39 | 39 | 39 | 39 | 40 | 40 |
| Average Efficiency | | | | 39% | | | |

TABLE III-continued

FULL LOAD Generator efficiency using Ferrite and Powdered Iron transformers.

POWDERED IRON

Toroid T80-6 Core
Pri = 6T Sec = 30T
L = 4.57 uH Capacitance = 220 pf
Load Resistance ≅ 14.4 Freqency = 4.950 Mhz
Vin = 220 Vdc Vout = 1099 Vp

| Speed and Frequency | Input Current (Measured) | Input Power Vin × 1 input | % ON-Time |
|---|---|---|---|
| 30 ft/min 3.6 KHZ | 12 | 2.64 | 0.396 |
| 50 ft/min 6 KHZ | 21 | 4.62 | 0.66 |
| 100 ft/min 12 KHZ | 42 | 9.240 | 1.32 |
| 150 ft/min 18 KHZ | 63 | 13.86 | 1.98 |
| 200 ft/min 24 KHZ | 84 | 18.48 | 2.64 |
| 250 ft/min 30 KHZ | 105 | 23.1 | 3.3 |
| 300 ft/min 36 KHZ | 126 | 27.72 | 3.96 |
| Load Resistor (R) | 14.4 | | |
| Xc = ½πfc | 176.84 | | |
| Z (Load) | 177.42 | | |
| Output Voltage (Measured) | 1099 Vpk | | |
| Ipk = E/Z | 6.19 Amp | | |
| Output Peak Power = $I^2R$ | 552.5 Watt | | |
| Output RMS Power = 0.707 $I^2R$ | 390.63 Watt | | |

| | | | | | | | |
|---|---|---|---|---|---|---|---|
| Actual RMS Power = RMS | 3.6 | 6 | 12 | 18 | 24 | 30 | 36 |
| Power X % ON-Time/100 @ various frequency | 1.5 | 2.6 | 5.2 | 7.7 | 10.3 | 12.9 | 15.5 |
| % Efficiency = 100 X Output Power/Input Power | 57 | 56 | 56 | 56 | 56 | 56 | 56 |
| Average Efficiency | | | | 56% | | | |

TABLE IV

SUMMARY

TEST CONDITIONED FOR GENERATOR.

| | |
|---|---|
| Burst Rate: | 36 KHz (300 ft/min) |
| Number of RF Cycle in Burst: | 6 |
| Output Voltage to Cartridge: | 2200 $V_{peak\text{-}peak}$ |
| Output Frequency to Cartridge: | 5.0 MHz (Nominal) |
| Cartridge equivalent Load: | Capacitance = 180 pf<br>Transformer stray capacitance ≅ 40 pf<br>Resistance = 14.4 Ω |

| | FERRITE | FERRITE | POWDERED IRON |
|---|---|---|---|
| Transformer used | Pot 1811 Philips AL24 | Pot 1811 Philips AL40 | Toroid T80-6 Micro Metals |
| Unloaded Q | 31 | 24 | 58 |
| loaded Q | 13 | 12 | 16 |
| Generator Power Efficiency | 37% | 39% | 56% |
| Transformer Efficiency = $(1 - Q_L/Q_U \times 100)$ | 58% | 50% | 74% |

It will be seen that the Tables I–IV indicate that an RF generator 10 according to the invention may be expected to have transformer efficiencies more than 10% (e.g. 16–24%) greater efficient than conventional, and generator power efficiencies also more than 10% (e.g. 17–19%) greater, than conventional generators.

Utilizing the RF generator 10 according to the invention, it is possible to image a substrate, such as paper, using an electron beam print cartridge 11 in a more efficient manner. The substrate may be moved at a speed greater than 200 feet per minute (e.g. 210–300 feet per minute) without sacrificing the quality of print, and while moving the substrate at that speed, the RF generator 10 may be operated at a frequency greater than 3 MHz to drive the cartridge 11 and thereby image the moving web. Preferably the operating procedure is practiced using a 600 DPI eighteen inch print cartridge 11, and to operate the RF generator 10 at a frequency of about 5 MHz.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. An electron beam printer assembly comprising:

an RF generator including a powdered iron core transformer, a power driver, control logic, and an oscillator feedback circuit, operatively connected to each other to provide an RF generator; and said transformer connected to an electron beam print cartridge.

2. An assembly as recited in claim 1 wherein said RF generator further comprises a dual pulse width generator operatively connected to said transformer.

3. An assembly as recited in claim 2 wherein said transformer comprises primary, secondary, and clamping windings, said secondary winding connected to said cartridge.

4. An assembly as recited in claim 3 wherein said cartridge comprises an 18 inch 600 DPI print cartridge; and wherein said assembly is capable of effectively printing a substrate moving at a speed over 200 feet per minute.

5. An assembly as recited in claim 2 wherein said dual pulse width generator comprises a NOR gate, a capacitor, two resistors, and a diode, all connected to an adjustable voltage source.

6. An assembly as recited in claim 1 wherein said transformer has a toroid-shaped core.

7. An assembly as recited in claim 1 wherein said transformer core is of carbonyl.

8. An assembly as recited in claim 3 wherein said dual pulse width generator comprises a NOR gate, a capacitor, two resistors, and a diode, all connected to an adjustable voltage source.

9. An assembly as recited in claim 6 wherein said transformer comprises primary, secondary, and clamping windings, said secondary winding connected to said cartridge.

10. An assembly as recited in claim 9 wherein said transformer core is of carbonyl.

11. An assembly as recited in claim 1 further comprising ten RF generators each including: a powered iron core transformer, a power driver, control logic, and an oscillator feedback circuit, operatively connected to each other to provide an RF generator.

12. An electron beam printer assembly comprising:

an RF generator including a dual pulse width generator connected to a transformer; and an electron beam print cartridge connected to said transformer;

wherein said dual pulse width generator comprises a NOR gate, a capacitor, two resistors, and a diode, all connected to an adjustable voltage source.

13. An assembly as recited in claim 12 wherein said transformer comprises primary, secondary, and clamping windings, said secondary winding connected to said cartridge.

14. An assembly as recited in claim 12 further comprising ten RF generators, each including a dual pulse width generator connected to a transformer; and wherein said cartridge has nineteen channels.

15. A method of imaging a substrate using an electron beam print cartridge and an RF generator, comprising:

(a) moving the substrate at a speed greater than 200 feet per minute; and (b) while practicing (a), operating the RF generator at a frequency greater than 3 MHz to drive the cartridge and thereby image the moving substrate, using said RF generator having a powdered iron core transformer, and a dual pulse width generator.

16. A method as recited in claim 15 wherein (b) is practiced using a 600 DPI 18 inch print cartridge, and operating the RF generator at a frequency of about 5 MHz.

17. A method as recited in claim 15 wherein (b) is practiced using a 600 DPI 18 inch print cartridge, and operating the RF generator at a frequency of about 5 MHz.

18. A method as recited in claim 15 wherein (b) is practiced to move the substrate at a speed between 210–300 feet per minute.

19. An electron beam printer assembly comprising:

an RF generator including a dual pulse width generator connected to a transformer;

an electron beam print cartridge connected to said transformer; and wherein said transformer comprises primary, secondary, and clamping windings, said secondary winding connected to said cartridge.

* * * * *